United States Patent [19]

Kuntz

[11] 4,172,690

[45] Oct. 30, 1979

[54] ARRANGEMENT FOR CENTERING THE IMPELLERS IN A MULTI-STAGE CENTRIFUGAL PUMP

[75] Inventor: Gerhard Kuntz, Homburg, Fed. Rep. of Germany

[73] Assignee: Klein, Schanzlin & Becker Aktiengesellschaft, Frankenthal, Fed. Rep. of Germany

[21] Appl. No.: 791,058

[22] Filed: Apr. 26, 1977

[30] Foreign Application Priority Data

Apr. 29, 1976 [DE] Fed. Rep. of Germany ..... 2618829

[51] Int. Cl.[2] ..... F04D 29/22

[52] U.S. Cl. ..... 415/199.2; 415/173 R; 415/176; 415/200; 415/214

[58] Field of Search ..... 415/199.2, 199.1, 501, 415/199.5, 128, 200, 214, 219 C; 417/423 R, 424, 360; 29/156.4 R, 156.8 R, 446, 511

[56] References Cited

U.S. PATENT DOCUMENTS

| | | | |
|---|---|---|---|
| 1,642,914 | 9/1927 | Whann | 415/199.1 |
| 2,166,404 | 7/1939 | Hait | 415/501 X |
| 3,070,026 | 12/1962 | Lung | 415/501 X |
| 3,238,879 | 3/1966 | Shallenberg | 415/199.2 X |
| 3,437,045 | 4/1969 | Tremain | 415/501 X |
| 3,676,013 | 7/1972 | Albertson | 415/199.2 X |
| 3,730,641 | 5/1973 | Gordon | 415/501 X |

FOREIGN PATENT DOCUMENTS 538987 11/1931 Fed. Rep. of Germany .

*Primary Examiner*—Everette A. Powell, Jr.
*Attorney, Agent, or Firm*—Peter K. Kontler

[57] ABSTRACT

The casings, partitions and impellers of neighboring stages of a submersible motor pump consist of synthetic plastic material and are stacked in a cylindrical pump body consisting of metallic material. The shells of the casings are biased axially so that they bulge outwardly into frictional engagement with the pump body, and each casing has a cylindrical hub which spacedly surrounds the nave of the respective impeller. Each impeller has a neck portion which is spacedly surrounded by the adjacent partition. The naves of the impellers are disposed end-to-end and are driven by the pump shaft. The annular gaps between the naves and neck portions of the impellers on the one hand, and the hubs of casings and partitions on the other hand are traversed by fluid streams when the impellers are driven whereby the streams produce forces which center the impellers with respect to the casings and partitions in accordance with the Lomakin effect.

9 Claims, 5 Drawing Figures

ARRANGEMENT FOR CENTERING THE IMPELLERS IN A MULTI-STAGE CENTRIFUGAL PUMP

CROSS-REFERENCE TO RELATED APPLICATION

The multi-stage centrifugal pump of the present invention constitutes an improvement over and a further developement of the pump which is disclosed in the commonly owned copending application Ser. No. 731,335 filed by Karl Reiss on Oct. 12, 1976, and now U.S. Pat. No. 4,120,606 dated Oct. 17, 1978.

BACKGROUND OF THE INVENTION

The present invention relates to improvements in multi-stage centrifugal pumps, especially submersible motor pumps or sump pumps. More particularly, the invention relates to improvements in the construction and assembly of pump stages in such pumps. Still more particularly, the invention relates to improvements in means for and in the manner of journalling the rotor of a multi-stage centrifugal pump, especially a multi-stage submersible motor pump, wherein the components of stages consist of or include synthetic plastic material.

It is known to produce the casings and impellers of stages in a centrifugal pump of a synthetic plastic material. Such parts of the pump stages are lightweight, resistant to corrosion, relatively inexpensive and can be mass-produced by resorting to any one of several well known techniques. However, the utilization of synthetic plastic parts in centrifugal pumps also presents several still unsolved problems, particularly as regards proper assembly and centering of rotary components and especially if it is desired to construct a compact centrifugal pump whose bearings are confined in the interior of the pump body. Such positioning of bearings is advantageous because the bearings can be lubricated by the conveyed fluid. In presently known centrifugal pumps of the just outlined character, the bearings consist of corrosion-resistant metallic material and each bearing is confined in a discrete housing. The space requirements of the housings for metallic bearings render it necessary to employ a relatively long pump shaft which extends through the stages as well as through the housings which alternate with the casings of neighboring stages.

Additional problems arise when the synthetic plastic parts of the stages are produced by mass-manufacturing techniques which invariably result in at least some deviations of dimensions of such parts from an optimum value. In many instances, the plastic parts (especially the casings of the pump stages) are produced with considerable tolerances and are loosely stacked in the pump body to be secured thereto (against rotation with the impellers and with the pump shaft) by resorting to simple and inexpensive rotation-preventing devices. This often results in misalignment of central openings of neighboring casings. If the rotor of such multi-stage pump is not centered with an extremely high degree of precision, i.e., in the absence of accurately machined and hence expensive bearings, the impellers are likely to rub against the respective casings when the pump is in use. This entails pronounced wear and reduces the useful life of the pump. Moreover, frictional engagement between the rotor and stator of a multi-stage pump wherein the stationary and rotary parts consist of synthetic plastic material is likely to generate sufficient heat to cause the rotary parts to become welded to the stationary parts. In order to prevent the development of such permanent bonds, many presently known centrifugal pumps which utilize synthetic plastic parts are equipped with metallic bearing rings which are interposed between the rotor and the stator. The bearing rings are used as a substitute for or in addition to the aforementioned bearings for the pump shaft.

OBJECTS AND SUMMARY OF THE INVENTION

An object of the invention is to provide a centrifugal pump, especially a multi-stage submersible motor pump or sump pump, wherein the component parts of the stages can be made of synthetic plastic material and wherein the rotary and stationary parts need not be separated from each other by any metallic bearing elements.

Another object of the invention is to provide a novel and improved multi-stage centrifugal pump wherein the impellers are automatically centered with respect to the casings and/or other parts in the interior of the pump body as soon as the rotor including the impellers and the pump shaft is set in motion.

A further object of the invention is to provide a multi-stage centrifugal pump, especially a submersible motor pump or the like, wherein the cost of properly centering the component parts of the stages is a fraction of the cost of centering such parts in heretofore known multi-stage pumps.

An additional object of the invention is to provide a multi-stage centrifugal pump wherein the plastic components of the rotor and stator cannot be bonded to each other as a result of excessive heating in spite of the fact that the pump body need not contain any metallic rings, other types of metallic bearing elements or housings for bearing elements.

The invention is embodied in a centrifugal pump, particularly in a submersible motor pump or sump pump. The pump comprises a tubular pump body or housing which preferably consists of metallic material and has a cylindrical internal surface, and a plurality of stacked pump stages in the pump body. Each stage comprises a stationary component (which may include two portions, namely, a casing and a partition which latter is disposed between the neighboring casings) consisting of synthetic plastic material and a rotary component (impeller) also consisting of synthetic plastic material. The stationary and rotary components of the stages define a plurality of annular gaps through which streams of conveyed fluid flow when the rotary components are driven whereby the conveyed fluid produces forces which center the rotary components in the respective stationary components in accordance with the Lomakin effect.

The aforementioned casings preferably include deformable cylindrical shells which are adjacent to the pump body and the pump then further comprises means for bulging the shells radially outwardly into frictional engagement with the internal surface of the pump body so that the latter automatically centers the casings. Each of the casings comprises an annular hub and each impeller has an annular nave which is spacedly surrounded by and defines an annular gap with the respectove hub. Each impeller preferably further comprises an annular neck portion which is spacedly surrounded by and defines a gap with the neighboring partition. The naves of the impellers are preferably disposed end-to-end (i.e., without any bearings therebetween) and surround an elongated pump shaft which is driven by a motor or another suitable prime mover to rotate the impellers with respect to the stationary components.

The novel features which are considered as characteristic of the invention are set forth in particular in the appended claims. The improved pump itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
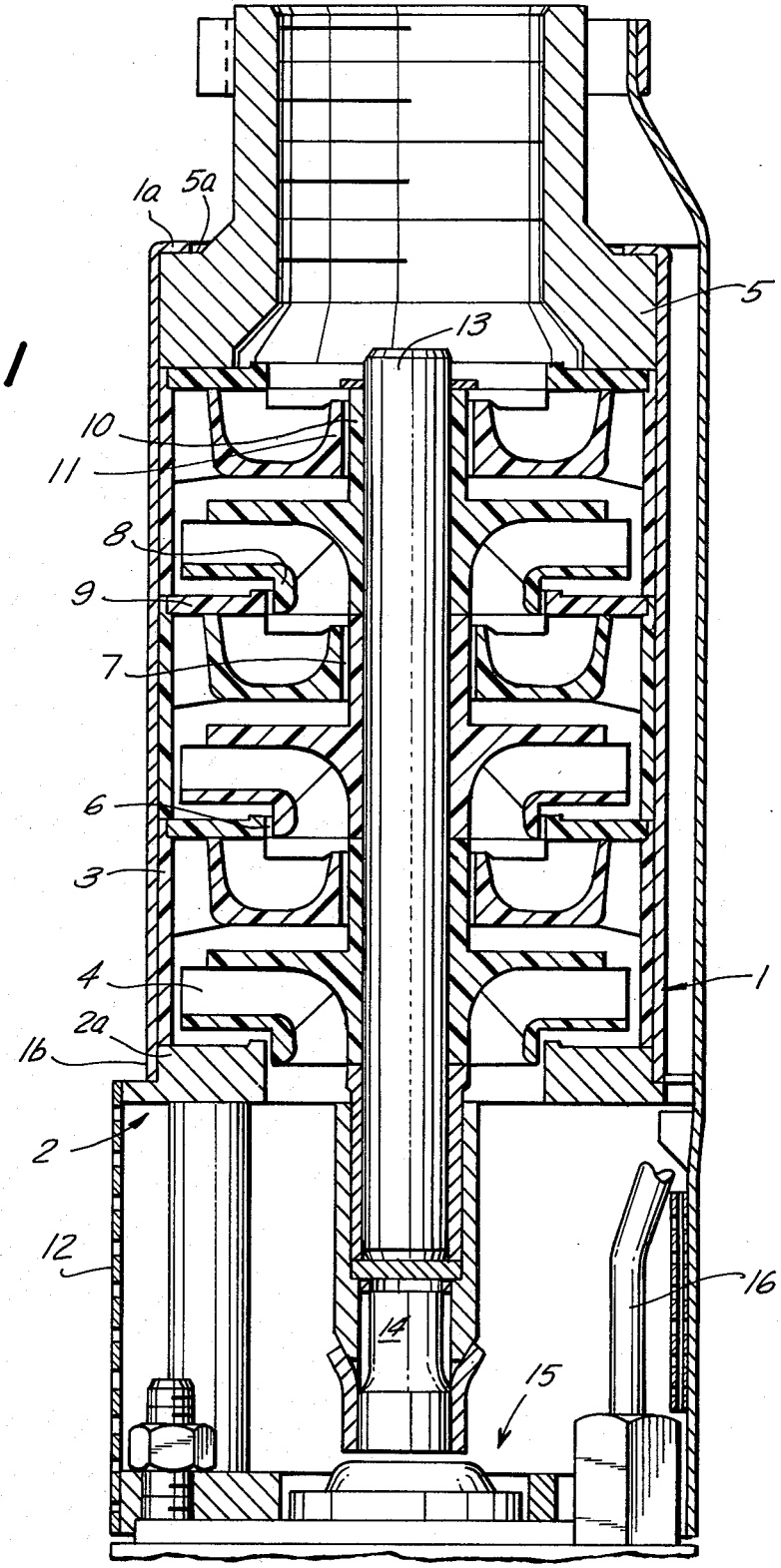
FIG. 1 is an axial sectional view of a multi-stage submersible motor pump which embodies the invention.

FIG. 1 shows a submersible motor pump having a cylindrical pump body or housing 1 the lower end portion of which receives a suction manifold 2. The latter has a flange which is connected to an intake strainer 12. The pump shaft 13 is driven by the output shaft 14 of a motor 15. The reference character 16 denotes a cable whose conductors connect the motor 15 with a source of electrical energy. The upper end portion of the body 1 receives a discharge head 5 which is connected to the rising main, not shown.

Each stage in the interior of the body 1 includes a stationary annular casing 3 and an impeller 4. The reference characters 9 denote disk-shaped annular partitions between neighboring casings 3. Each partition 9 defines with the neck portion 8 of the adjacent impeller 4 an annular throttling gap 6, and the hub 11 of each casing 3 defines with the nave 10 of the respective impeller 4 an annular throttling gap 7.

Figure 2:
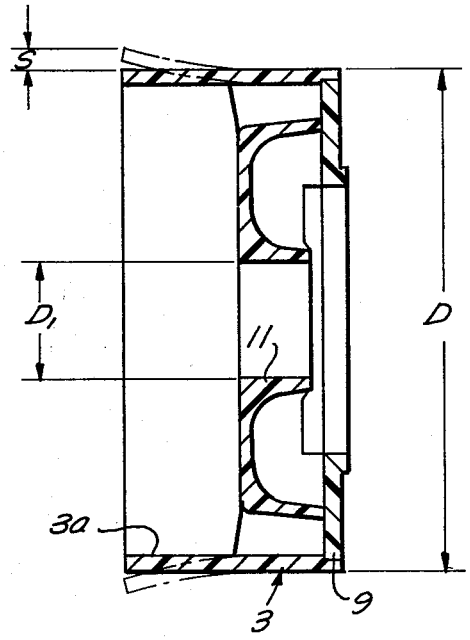
FIG. 2 is an axial sectional view of the casing of a stage in the pump of FIG. 1, the expanded position of the cylindrical shell of the casing being indicated by broken lines.

The manner in which the pump is assembled is preferably the same as disclosed in the copending application Ser. No. 731,335 of Reiss. Thus, the casings 3 and impellers 4 of the stages are inserted into and stacked in the body 1, together with the respective partitions 9, and the discharge head 5 is thereupon introduced on top of the uppermost partition 9. The upper marginal portion 1*a* of the body 1 is upset over the shoulder 5*a* of the head 5 so that the casings 3 are subjected to axial stresses and their outer walls or shells 3*a* (see FIG. 2) expand (bulge) radially in a manner as indicated by phantom lines. The magnitude of such axial stresses remains unchanged or fluctuates within a narrow range because the just mentioned connection between the marginal portion 1*a* and the discharge head 5 is sufficiently stable to insure that the body 1 cannot move axially with respect to the head 5 or vice versa. The axes of the casings 3 coincide with the axis of the body 1.

The parts 3, 4 and 9 consist of suitable synthetic plastic material. The material of the casings 3 is sufficiently elastic to insure that each casing is automatically centered in the body 1 when the stages are subjected to axial stresses in response to insertion and retention of the head 5 in the position shown in FIG. 1, i.e., at such a distance from the suction manifold 2 that the shells 3*a* of the casings 3 remain deformed and cannot rotate with the body 1. The lower end portion 1*b* of the body 1 is welded to the smaller-diameter upper portion 2*a* of the manifold 2.

The improved pump need not be provided with any special bearings for the rotary parts in the housing or body 1. Thus, the pump shaft 13 is centered by the naves 10 of the impellers 4, and the shells 3*a* of the casings 3 are centered by the cylindrical internal surface of the body 1. Actually, the improved pump need not comprise any metallic parts in the interior of the body 1. The partitions 9 automatically center the neck portions 8 of the adjacent impellers 4 owing to the Lomakin effect which develops in response to flow of fluid streams through the respective gaps 6. Analogously, the Lomakin effect which develops in response to flow of fluid streams through the gaps 7 automatically centers the naves 10 of the impellers 4 with respect to the hubs 11 of the corresponding casings 3. The just mentioned streams develop as soon as and when the improved pump is in use.

The parts in the interior of the body 1 are preferably produced by resorting to an injection molding technique. For example, the casings 3 are preferably formed in a mold wherein the mold part which defines the external surface (see the diameter D in FIG. 2) of the shell 3*a* is rigidly connected with the mold part which defines the internal surface (see the diameter $D_1$ in FIG. 2) of the hub 11. This insures that the axes of such surfaces coincide in each of a series of casings. When the casings 3 are stacked on top of each other in the pump body 1 and are subjected to axial stresses which cause their shells 3*a* to bulge outwardly (as shown as s in FIG. 2) and to frictionally engage the cylindrical internal surface of the body 1, the axial openings in their hubs 11 are automatically held in exact register with each other. This insures that the naves 10 of the impellers 4 are held out of contact with the respective hubs 11. In fact, such contact is not even likely to occur when the motor 15 is started because the stages begin to build up a differential pressure in response to one or a small number of initial revolutions of the output shaft 14. The fluid streams which flow through the gaps 6 and 7 in response to development of such differential pressure between neighboring stages immediately center the parts which flank the respective gaps due to the aforementioned Lomakin effect. Such centering maintains the impellers 4 in optimum positions with respect to the adjacent stages 3 and partitions 9. The magnitude (and hence the centering action) of forces which develop as a result of the Lomakin effect depends on the geometry of the gaps 6 and 7, i.e., it is a function of factors which can be determined by the designer so that the designer can select, in advance, the centering action of fluid streams which flow through the gaps 6, 7.

The improved pump is susceptible of many modifications without departing from the spirit of the invention. For example, the number of stages can be reduced to two (or even one) or increased to four or more. Furthermore, the manner in which the suction manifold 2 and/or the discharge head 5 can be secured to the pump body 1 in order to subject the shell 3*a* of casings 3 to axial deforming stresses can be changed in a number of ways, for example, as disclosed in the copending application Ser. No. 731,335 of Reiss. Still further, the pump can be used as a sump pump and the motor can be installed at a level above the uppermost stage. All that counts is to employ a pump body 1 which is sufficiently straight and whose inner diameter is sufficiently constant to insure that the shells 3*a* of the casing 3 can be subjected to predictable axial stresses which result in satisfactory frictional engagement of their external surfaces with the body 1, and preferably also that the axes of the external surfaces of the shells 3*a* coincide with the axes of the internal surfaces of the hubs 11 in order to insure that the width of the gaps 7 can be determined in advance. The same preferably also applies for the width of the gaps 6. Otherwise stated, the axes of the internal and external surfaces of the casings 3 preferably coincide with the axis of the pump body 1, and the axes of internal surfaces of partitions 9 preferably coincide with the axes of external surfaces of neck portions 8 and with the axis of the body 1.

With reference to FIG. 1, the Lomakin effect can be explained as follows: Assume that the nave 10 of the impeller 4 which is surrounded by the gap identified by the reference character 7 is centered in the respective hub 11. When the motor 15 is started to rotate the shaft 13, the latter rotates the nave 10 and causes the fluid to flow upwardly, as viewed in FIG. 1, i.e., axially of the shaft 13 and through the gap 7. The width of the gap 7, as considered in the circumferential direction of the nave 10, is constant because the nave is centered in the impeller 4. The pressure of fluid at the lower end of the gap 7 exceeds the pressure at the upper end of the gap, and the pressure drop (as considered in the axial direction of the nave 10) is gradual all the way from the lower to the upper end of the gap. If the shaft 13 moves sideways, the width of the gap 7 decreases at one side and increases at the diametrically oppositie side of the nave 10. The pressure of fluid in the narrower portion of the gap 7 increases, and such fluid produces a so-called Lomakin force which returns the shaft 13 and the nave 10 to the original position in which the width of the gap is constant. This effect (i.e., automatic return of the shaft 13 and nave 10 to a position of coaxiality with the hub 13) is the Lomakin effect.

Without further analysis, the foregoing will so fully reveal the gist of the present invention that others can, by applying current knowledge, readily adapt it for various applications without omitting features that, form the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. In a centrifugal pump, particularly in a submersible motor pump or sump pump, the combination of a tubular pump body; a plurality of coaxial pump stages in said body, each of said stages including a stationary component consisting of synthetic plastic material and a rotary component also consisting of synthetic plastic material, said stationary and rotary components defining permanent annular gaps through which streams of conveyed fluid flow when said rotary components are driven whereby the conveyed fluid produces Lomakin forces constituting the sole means for centering the rotary components relative to the respective stationary components; and means for subjecting said stationary components to deforming stresses acting in the axial direction of said rotary components.

2. The combination of claim 1, wherein said stationary components include casings each having a deformable shell adjacent said body, said means for subjecting said stationary components to deforming stresses comprising means for bulging said shells radially outwardly into frictional engagement with said body.

3. The combination of claim 2, wherein each of said casings further includes an annular hub and each of said rotary components is an impeller having an annular nave spacedly surrounded by and defining a gap with the hub of the respective casing.

4. The combination of claim 1, wherein each of said stages further includes a stationary casing in frictional engagement with said body, said stationary components including annular partitions between the casings of neighboring stages and each of said rotary components constituting an impeller having an annular neck portion spacedly surrounded by and defining a gap with the neighboring partition.

5. The combination of claim 1, wherein each of said stationary components includes two discrete portions one of which constitutes a casing having a shell in frictional engagement with said body and an annular hub, the other of said portions constituting an annular partition disposed between the casings of neighboring stages in said body, each of said rotary components constituting an impeller having a neck portion spacedly surrounded by and defining a first annular gap with the neighboring partition, each of said impellers further having an annular nave spacedly surrounded by and defining a second annular gap with the hub of the respective casing.

6. The combination of claim 1, further comprising a common drive shaft extending through and coaxial with all of said rotary components.

7. The combination of claim 1, wherein said body consists of metal and has a cylindrical internal surface.

8. The combination of claim 1, wherein said rotary components are impellers having coaxial naves disposed end-to-end.

9. The combination of claim 8, wherein each of said stationary components consists of several discrete portions at least one of which is deformable, said means for subjecting said stationary components to deforming stresses comprising means for maintaining said deformable portions in frictional engagement with said body.

* * * * *